US005967256A

United States Patent [19]

Takahashi

[11] Patent Number: 5,967,256

[45] Date of Patent: Oct. 19, 1999

[54] FOOTHOLD

[75] Inventor: Eizo Takahashi, Soka, Japan

[73] Assignee: Miyama Kogyo Kabushiki Kaisha, Saitama, Japan

[21] Appl. No.: 09/272,265

[22] Filed: Mar. 19, 1999

[51] Int. Cl.[6] ..... E02D 29/12

[52] U.S. Cl. ..... 182/92; 182/90

[58] Field of Search ..... 182/90, 92

[56] References Cited

U.S. PATENT DOCUMENTS

| | | |
|---|---|---|
| 165,403 | 7/1875 | Blatt . |
| 601,849 | 4/1898 | Aiken . |
| 1,729,963 | 10/1929 | Pease . |
| 2,064,803 | 12/1936 | Grove . |
| 2,511,077 | 6/1950 | Race, Jr. . |
| 4,100,997 | 7/1978 | Peacock . |
| 4,241,543 | 12/1980 | Foscarini et al. . |
| 4,610,330 | 9/1986 | Borst . |
| 4,655,318 | 4/1987 | Bowen . |
| 4,660,681 | 4/1987 | Zenhausern . |
| 4,702,349 | 10/1987 | Zenhausern . |
| 4,771,861 | 9/1988 | Zenhausern et al. . |
| 4,778,032 | 10/1988 | Takahashi . |
| 4,869,342 | 9/1989 | Borst . |
| 5,427,198 | 6/1995 | Walsh . |
| 5,752,579 | 5/1998 | Takahashi . |
| 5,772,358 | 6/1998 | Takahashi . |

FOREIGN PATENT DOCUMENTS

| | | |
|---|---|---|
| 173 227A | 3/1986 | European Pat. Off. . |
| 4-4040 | 6/1992 | Japan . |
| 6-71899 | 7/1994 | Japan . |
| 2819106 | 7/1996 | Japan . |
| 2700618 | 3/1997 | Japan . |
| 09195295 | 7/1997 | Japan . |
| 10292412 | 11/1998 | Japan . |
| 470 919 | 8/1937 | United Kingdom . |

*Primary Examiner*—Alvin Chin-Shue

*Attorney, Agent, or Firm*—Flynn, Thiel, Boutell & Tanis, P.C.

[57] ABSTRACT

A foothold including a tread, side portions positioned at both sides of the tread, and legs to be inserted into a concrete wall. The tread, side portions and legs are formed of a core covered by synthetic resins. A plurality of fins are provided axially on outer peripheries of the synthetic resins which cover the legs, and pins are provided on the side portions so as to extend radially therefrom at portions adjacent boundaries between the side portions and legs. Universal washers are provided and are pressed against the concrete wall by the respective pins which are engaged in the side portions. The universal washers have substantially elliptical holes through which the side portions extend, and recessed grooves are provided along the short axis of the elliptical holes for accommodating the pins. With this arrangement, the legs can be easily and reliably fitted into the holes defined in the wall surface so that the foothold can be reliably fixed to a manhole wall. Further, since the universal washers are detachable from the foothold, a foothold small in size and low in cost can be achieved.

10 Claims, 6 Drawing Sheets

FOOTHOLD

BACKGROUND THE INVENTION

1. Field of the Invention

The present invention relates to a foothold comprising a tread, side portions positioned at both sides of the tread and legs to be inserted into a concrete wall.

2. Background of the Invention

A conventional foothold including a tread, side portions positioned at both sides of the tread and legs to be inserted into a concrete wall is disclosed in Japanese Patent Laid-Open Publication 10-292412, which foothold includes spherical bodies integrally formed with the side portions at boundaries between the side portions and legs, and collar pieces fitted to the curved wall (such as a manhole inner wall) are slidably provided on the spherical bodies, wherein the collar pieces are pressed against the wall surface.

In the conventional foothold, if the diameters of the spherical bodies in which the collar pieces fitted to the curved wall such as the manhole inner wall are small, the collar pieces easily come out from the spherical bodies and hence the collar pieces can not be reliably retained relative to the spherical bodies, leading to a drawback that the foothold can not be reliably held relative to the manhole inner wall. On the other hand, if the diameters of the spherical bodies are large, the collar pieces are slidable relative to the spherical bodies, leading to a drawback that the collar pieces are also made large like the spherical bodies, and the tip ends of the spherical bodies are brought into contact with the manhole inner wall when the foothold is fixed to the inner wall. To avoid such drawbacks, the spherical bodies are provided such that they protrude a large amount from the side portions of the foothold, thereby making the entire foothold large.

SUMMARY OF THE INVENTION

The present invention has been made in view of the problems with conventional footholds discussed above. It is an object of the present invention to provide a small-sized and low cost foothold capable of pressing against a wall surface by fitting the universal washers to various wall surfaces such as curved or straight walls like a manhole inner wall or an inclined wall of shore protection and so forth, and of reliably and easily fitting the legs to the holes defined in the wall surface, whereby the foothold can be reliably fixed to the wall of a manhole and so forth.

To achieve the above object, the foothold according to one aspect of the present invention includes a tread, side portions positioned at both sides of the tread, legs to be inserted into a concrete wall, the tread, side portions and legs being formed of a core and first and second synthetic resins for covering the core, said second synthetic resins for covering the core of the legs having a substantially circular shape in cross section, and the first and second synthetic resins and being integrated with each other, a plurality of fins provided axially on outer peripheries of the synthetic resins in a plurality of stages in the direction from the legs toward the side portions, a plurality of pins provided on the side portions to extend radially therefrom at portions adjacent boundaries between the side portions and legs, the pins being vertically oriented, a plurality of universal washers to be pressed against the concrete wall by the pins being engaged in the side portions from the legs toward the pins, the universal washers having substantially elliptical holes through which the side portions penetrate, and recessed grooves provided for accommodating the pins.

The foothold according to another aspect of the present invention includes pins which are positioned laterally on the side portions.

The foothold according to yet another aspect of the present invention includes the upper surface of the tread being inclined upward from the central portion toward the both ends thereof at the angle of 1 to 5 degrees.

The foothold according to still another aspect of the present invention includes reflectors provided on the tread at portions adjacent both ends thereof, wherein the right reflector is red and the other reflector is green.

The foothold according to an additional aspect of the present invention includes the tread 2 has a wave-shaped grip portion provided at the inner side surface thereof in the axial direction and another wave-shaped grip portion provided at the lower surface of the tread in the axial direction having irregularities thereon.

The foothold according to another aspect of the present invention includes belt-shaped projections formed along the outer ends of both side portions.

The foothold according to yet another aspect of the present invention includes rise portions directed upward from both ends of the tread wherein the rise portion has side portions provided on upper ends of the rise portions.

The foothold according to still another aspect of the present invention includes blow receiving portions at the front side of the tread when the legs are embedded in the concrete wall.

The foothold according to an additional aspect of the present invention is includes a tread, side portions positioned at both sides of the tread, legs to be inserted into a concrete wall, the tread, side portions and legs being formed of a core, first and second synthetic resins for covering the core, the second synthetic resin for covering the core of the legs having a substantially circular shape in cross section, and the first and second synthetic resins being integrated with each other, a plurality of fins provided axially on outer peripheries of the synthetic resins in a plurality of stages in the direction from the legs toward the side portions, a plurality of pins provided on the side portions to extend radially therefrom at portions adjacent boundaries between the side portions and legs and positioned vertically and laterally, a plurality of universal washers to be pressed against the concrete wall by the pins being engaged in the side portions from the legs toward the pins, said universal washers having substantially elliptical holes in cross section through which the side portions penetrate, and recessed grooves provided at short axis of the elliptical holes for accommodating the pins, characterized in that the upper surface of the tread is inclined upward from the central portion toward the both ends thereof at the angle of 1 to 5 degrees, and reflectors are provided on the tread at portions adjacent both ends thereof, wherein the right reflector is red and the left reflector is green, while the tread has a wave-shaped grip portion provided at the inner side surface thereof in the axial direction and another wave-shaped grip portion provided at the lower surface of the tread in the axial direction having irregularities thereon, and also has belt-shaped projections formed along the outer ends of both side portions 3 and blow receiving portions provided at the front side of the tread when the legs are embedded in the concrete wall.

The foothold according to a further aspect of the present invention includes a tread, side portions positioned at both sides of the tread, legs to be inserted into a concrete wall, said tread, side portions and legs being formed of a core, first and second synthetic resins for covering the core, said second synthetic resins for covering the core of the legs having a substantially circular shape in cross section, and the first and second synthetic resins being integrated with each other, a plurality of fins provided axially on outer peripheries of the synthetic resins in a plurality of stages in the direction from the legs toward the side portions, a plurality of pins provided on the side portions to extend radially therefrom at portions adjacent boundaries between the side portions and legs and positioned vertically and laterally, a plurality of universal washers to be pressed against the concrete wall by the pins being engaged in the side portions from the legs toward the pins, said universal washers having substantially elliptical holes in cross section through which the side portions penetrate, and recessed grooves provided at short axis of the elliptical holes for accommodating the pins, characterized in that rise portions directed upward from both ends of the tread and having side portions on upper ends thereof are formed, and the upper surface of the tread is inclined upward from the central portion toward the both ends thereof at the angle of 1 to 5 degrees, and reflectors are provided on the tread at portions adjacent both ends thereof, wherein the right reflector is red and the left reflector is green, while the tread has a wave-shaped grip portion provided at the inner side surface thereof in the axial direction and another wave-shaped grip portion provided at the lower surface of the tread in the axial direction having irregularities thereon, and also has blow receiving portions provided at the front side of the tread or at the front side of rise portion when the legs are embedded in the concrete wall.

PREFERRED EMBODIMENT OF THE INVENTION

A foothold according to a first embodiment of the invention is described with reference to FIGS. 1–9.

Figure 1:
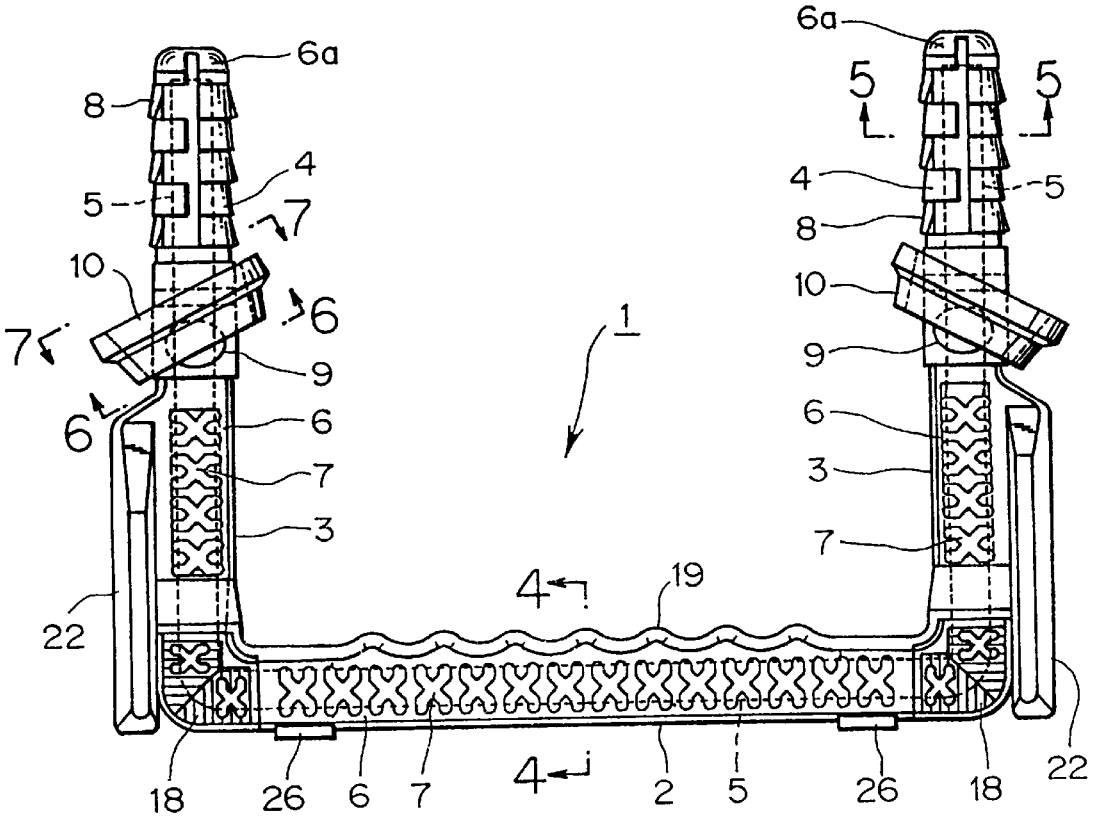
FIG. 1 is a plan view of a foothold according to a first embodiment of the present invention.

In FIG. 1, a reference numeral 1 depicts an entire configuration of a foothold. The foothold 1 comprises a tread 2, side portions 3 positioned at both sides of the tread 2, and legs 4 embedded in and fixed to a concrete wall and so forth. These tread 2, side portions 3 and legs 4 are formed of a core 5 made of iron and have a substantial U-shape as viewed from the plane and first synthetic resins 6 such a polypropylene cover the core 5 for keeping the core 5 from rusting. Slip prevention patterns 7 are formed on the entire surfaces of the tread 2 and side portions 3.

Second synthetic resins 6*a* covering the core 5 at the legs 4 have a substantially circular shape in cross section and a plurality of (e.g., two) fins 8 are provided axially on the outer peripheries of the second synthetic resins 6*a* in a plurality of (e.g., three) stages in the direction from the legs 4 toward the side portions 3, wherein the fins 8 are integrated with the second synthetic resins 6*a*. Tip ends of the fins 8 are slightly curved so as to expand its diameter outward.

Denoted by 9 are pins provided on the side portions 3 to extend radially therefrom at portions adjacent boundaries between the side portions 3 and the legs 4 and positioned vertically, namely, up and down relative to the boundaries and the universal washers 10 to be pressed by the pins 9 are engaged in each side portion 3 in the direction from the leg 4 toward the pins 9.

Figure 6:
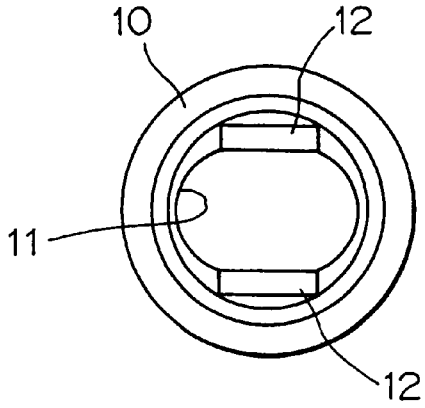
FIG. 6 is an enlarged view of a universal washer as viewed from the line 6—6 in FIG. 1.
Figure 7:
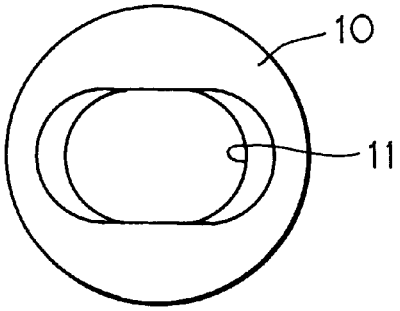
FIG. 7 is an enlarged view of a universal washer as viewed from the line 7—7 in FIG. 1.
Figure 8:
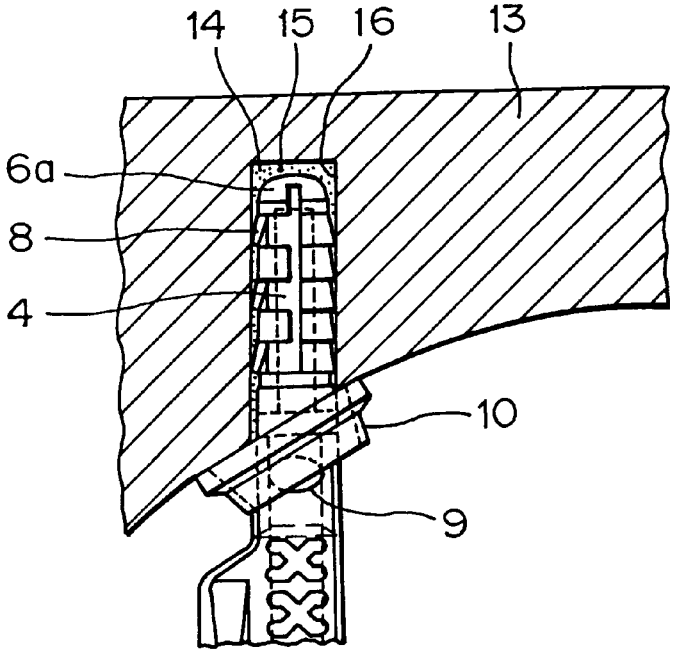
FIG. 8 is a plan view of a main portion of a foothold which is fixed to a curved wall such as a manhole inner wall.

As shown in FIGS. 6 and 7, the universal washers 10 made of synthetic resins have substantially elliptical holes 11 through which the side portions 3 penetrate and recessed grooves 12 are provided at opposite ends of the short axis of the elliptical holes 11 for accommodating the pins 9.

In the foothold 1 having the construction set forth above, the universal washers 10 are inserted from the legs 4 toward the pins 9 provided on the side portions 3 to extend radially therefrom, and the pins 9 are engaged in the recessed grooves 12 so that the universal washers 10 can be fixed to the foothold 1. Since the holes 11 having substantially elliptical shape in cross section through which the side portions 3 are formed elliptically conical, the universal washers 10 are swingable. As a result, the universal washers 10 are brought into contact with a curved or straight concrete wall while fitting therebetween, so that a vertical rattling can be reliably prevented. Further, the legs 4 are inserted into holes 14 defined in an inner wall 13 of a manhole in a state where the tip ends of the fins 8 are pressed by inner hole walls 16 of holes 14 after filling the holes 14 of the inner wall 13 with epoxy resins 15 and so forth. Subsequently, the entire foothold 1 is slightly pulled toward a person. As a result, the tip ends of the fins 8 are retained relative to the inner hole walls 16 of the holes 14 while they are expanded in diameter so that the lateral rattling of the legs 4 can be reliably prevented while interlocked with the epoxy resins 15 and so forth. With these operations, the legs 4 are brought into air-tight contact with the inner wall 13, and hence the legs 4 can be reliably fixed to the inner wall 13 (see FIG. 8).

Figure 9:
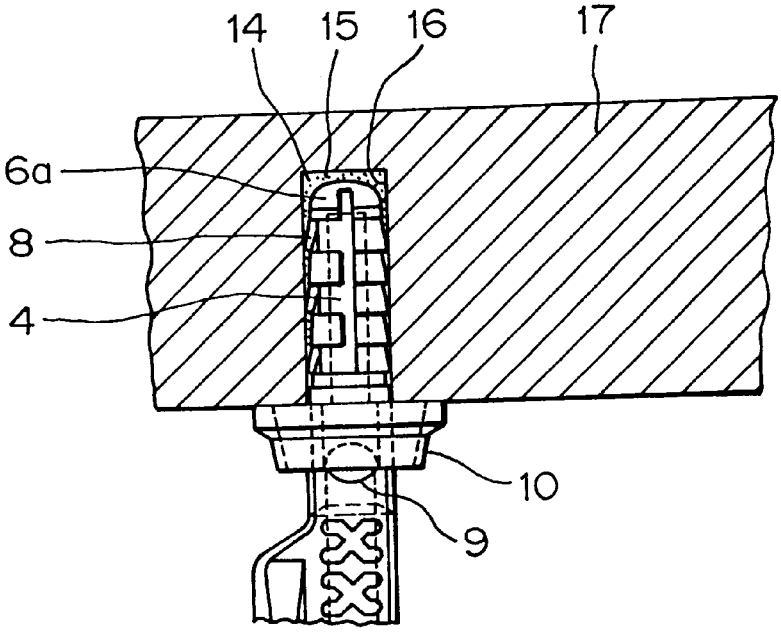
FIG. 9 is a plan view of a main portion of a foothold which is fixed to an inclined wall of a shore protection.

FIG. 9 is a plan view of a main portion of the foothold 1 fixed to an inclined wall 17 of a shore protection and so forth. In FIG. 9, the pins 9 are provided on the side portions 3 to extend radially therefrom or right and left on the side portions 3 and the universal washers 10 are inserted and engaged in the side portions 3 while the recessed grooves 12 of the universal washers 10 are positioned right and left of the side portions 3. Other components are the same as those of the first embodiment.

In the foothold having the construction set forth above, when the foothold is assembled with or fixed to the inclined wall 17 of the shore protection, the universal washers 10 are vertically swung and pressed against the inclined wall 17 so as to fit to the inclined wall 17 so that the tip ends of the fins 8 are retained relative to the holes of the inclined wall 17 while they are expanded in diameter, and hence the foothold is reliably fixed to the inclined wall 17 while interlocked with epoxy resins 15 (see FIG. 9)

The upper surface of the tread 2 is varied in the manner that it is inclined upward from the center S toward both ends thereof at the angle of 1 to 5 degrees. As a result, both feet of a person can be placed on the tread 2 with safety so that the working can be safely performed by the person.

Reflectors 18 are provided on both end corners of the tread 2. If the right reflector 18 is red while the left reflector 18 is green, the right and left positions of the foothold are made clear, thereby orienting the foothold in a specific direction.

A wave-shaped grip portion 19 is provided on the tread 2 at the inner side thereof in the axial direction thereof. Another wave-shaped grip portion 21 having irregularities 20 is formed on the tread 2 at the lower surface thereof.

In this case, although it is normally conceived that the person goes up and down the foothold 1 while gripping the foothold 1 that is positioned several stages above the foothold 1 on which the person places both of his or her legs, the tread 2 can be easily gripped because the wave shape is formed on the inner side of the tread 2 in the axial direction. Still further, since the tread 2 has the wave-shaped grip portion 21 having the irregularities 20 on the lower surface of the tread 2 in the axial direction, both hands can be prevented from slipping so that the person can go up and down the foothold 1 safely.

Denoted by 22 are belt-shaped projections formed along the outer end portions of the side portions 3. With the provision of these projections 22, even if both legs are placed on the side portions 3 when working, the working can be safely performed by the person since lateral slipping from the tread 2 is prevented by the projections 22.

Figure 2:
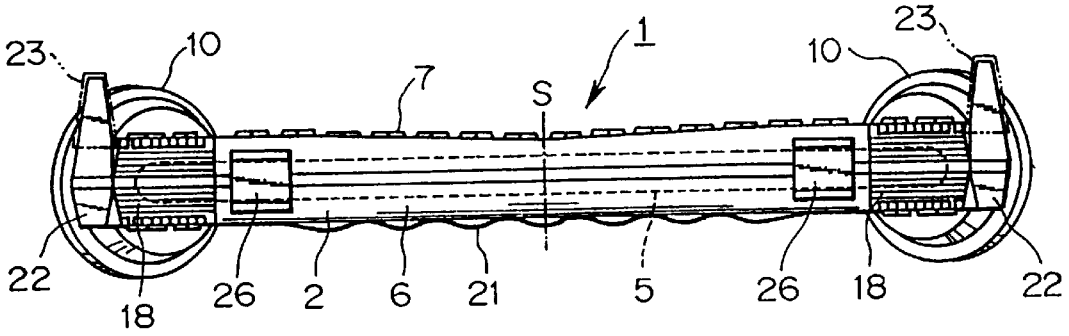
FIG. 2 is a front view of the foothold in FIG. 1.
Figure 3:
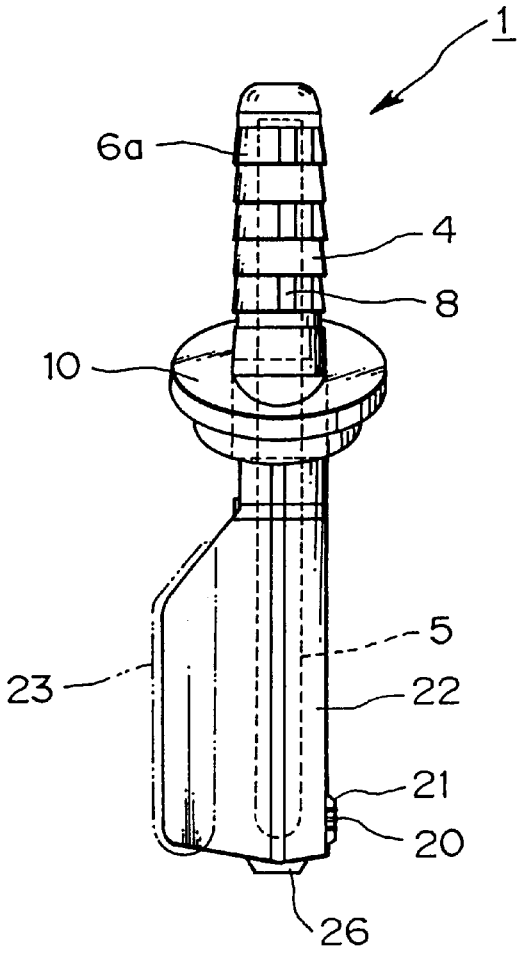
FIG. 3 is a side view of the foothold in FIG. 1.
Figure 4:
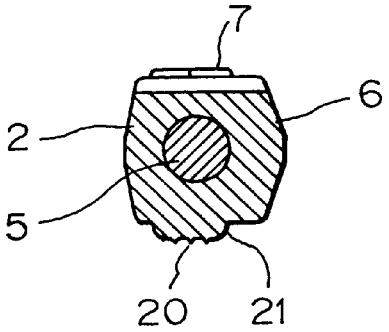
FIG. 4 is an enlarged sectional view of the foothold taken along line 4—4 in FIG. 1.
Figure 5:
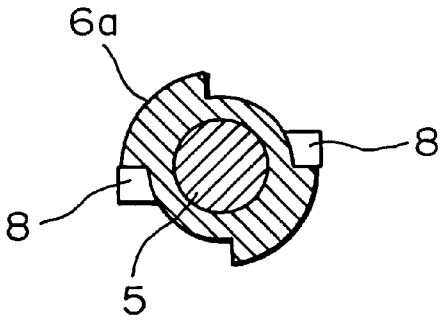
FIG. 5 is an enlarged sectional view of the foothold taken along line 5—5 in FIG. 1.

It is possible to cover the back surfaces of the projections 22 with reflectors 23, as shown by imaginary lines in FIGS. 2 and 3, whereby the areas of the reflectors increase so that the position of the foothold 1 is made clearer.

Figure 10:
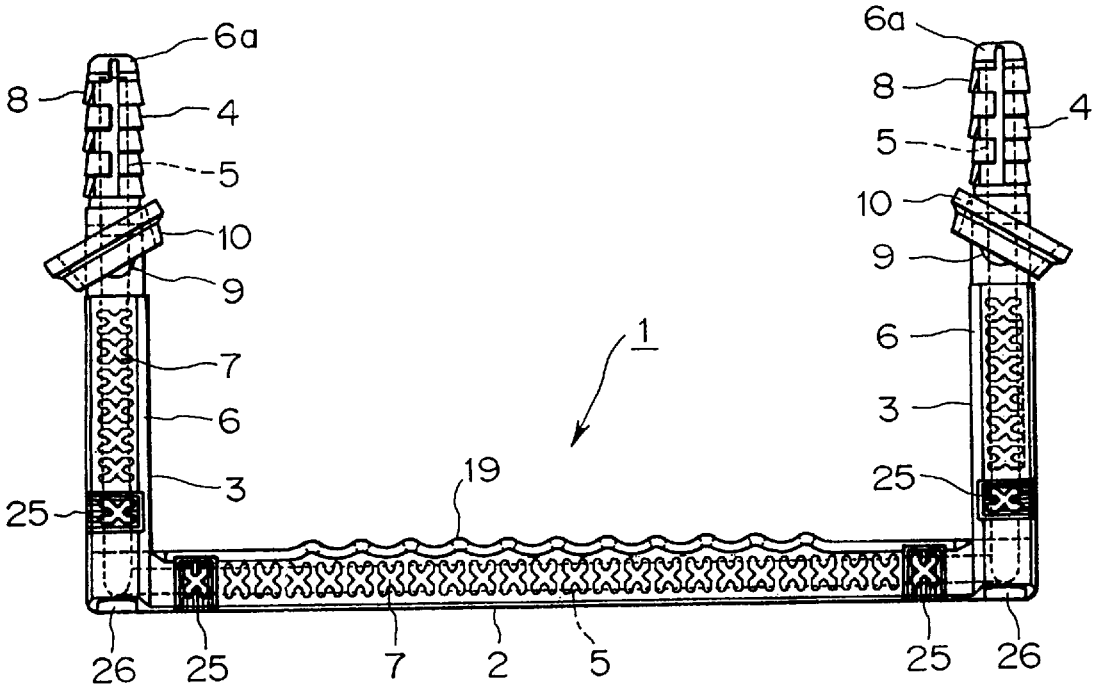
FIG. 10 is a plan view of a foothold according to a second embodiment of the present invention.
Figure 11:
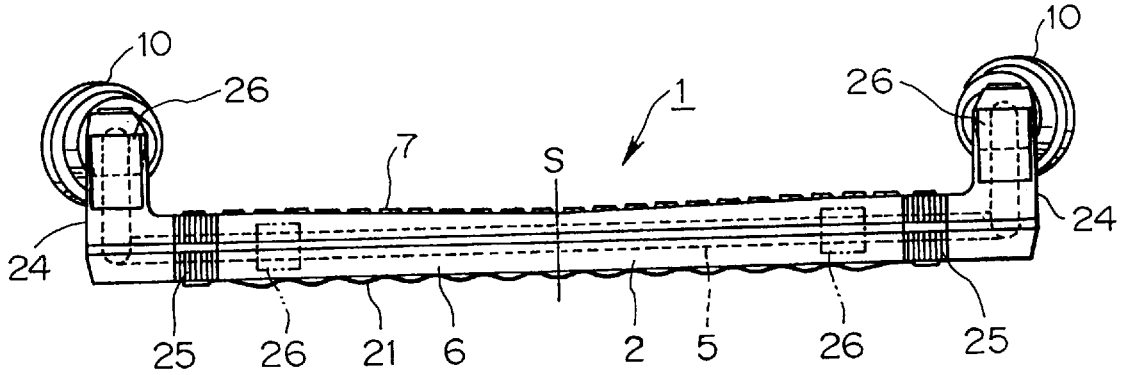
FIG. 11 is a front view of the foothold in FIG. 10.
Figure 12:
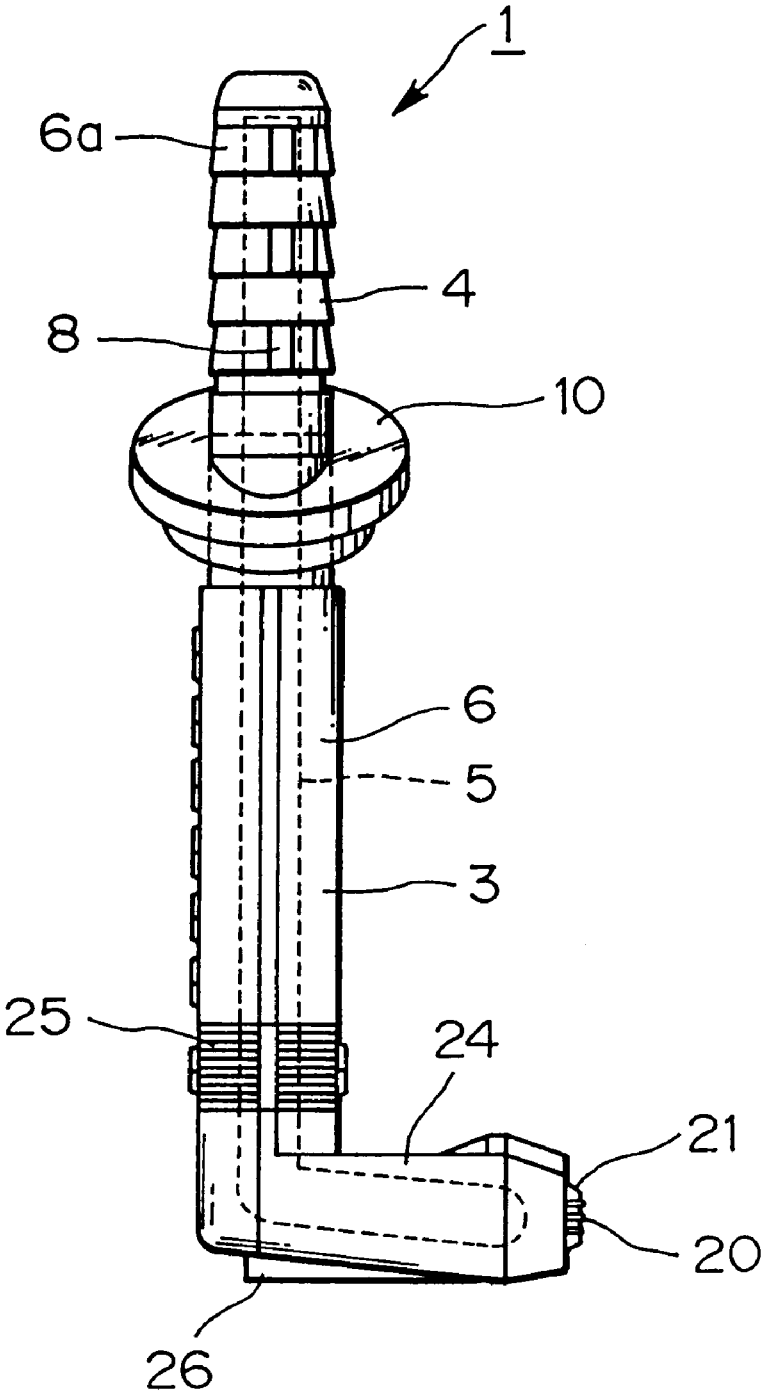
FIG. 12 is a side view of the foothold in FIG. 10.

A foothold according to a second embodiment of the invention is described with reference to FIGS. 10 to 12.

In these figures, rise portions 24 are formed on both ends of the tread 2 while the former is directed upward from the latter. Side portions 3 are formed on the upper ends of the respective rise portions 24. Reflectors 25 are provided on portions adjacent both ends of the tread 2 and the portion adjacent the rise portions 24 of the side portions 3. Since other components of the foothold 1 of the second embodiment are substantially the same as those of the first embodiment, they are denoted by the same reference numerals, and hence the explanation thereof is omitted.

In the foothold 1 having the construction set forth above, even if both legs are placed on both ends of the tread 2 when using the foothold 1, both legs are prevented from laterally slipping by the rise portions 24, thereby providing a safe foothold.

Further, since the pins 9 are provided on the side portions 3 to extend radially therefrom and positioned vertically or laterally, the foothold 1 can be pressed against and fixed to various walls such as a curved or straight inner wall of a manhole or an inclined wall of a shore protection while the universal washers 10 are fitted to these walls.

At least one blow receiving portion 26 that is used when embedding the foothold 1 formed of synthetic resins into the concrete wall is provided on the front sides of the rise portions 24, and the blow receiving portion 26 is integrally formed with the first synthetic resins 6 of the tread 2 at the rise portions 24.

There is a case where the legs 4 are hardly embedded or inserted into the inner wall of a concrete wall even if the foothold 1 is pressed against the inner wall by hands when fixing the foothold 1 to the concrete wall. In this case, it is normally conceivable that the front side of the tread 2 is blown, hit or pounded by a hammer and so forth to embed or insert the legs 4 into the inner wall. With the provision of the blow receiving portions 26, the front side of the tread 2 is hardly damaged, and hence the foothold 1 can be reliably fixed to the concrete wall. Further, as shown by an imaginary line of FIG. 11, two blow receiving portions 26 may be formed on the front side of the tread 2 or one blow receiving portion 26 may be formed on the central front side of the tread 2 if the width of the tread is narrow.

According to the foothold of the first aspect of the invention, the foothold includes a tread, side portions positioned at both sides of the tread, legs to be inserted into a concrete wall, the tread, side portions and legs being formed of a core and first and second synthetic resins for covering the core, the second synthetic resins for covering the core of the legs having a substantially circular shape in cross section, and the first and second synthetic resins being integrated with each other, a plurality of fins provided axially on outer peripheries of the synthetic resins in a plurality of stages in the direction from the legs toward the side portions, a plurality of pins provided on the side portions to extend radially therefrom at portions adjacent boundaries between the side portions and legs and positioned vertically, a plurality of universal washers to be pressed against the concrete wall by the pins being engaged in the side portions from the legs toward the pins, said universal washers having substantially elliptical holes through which the side portions penetrate, and recessed grooves provided at the short axis of the elliptical holes for accommodating the pins, the small sized universal washers are swingable in accordance with the shape of the wall surface so that the universal washers can be reliably fitted to the wall surface. As a result, the legs can be easily and reliably fitted to the holes defined in the wall surface so that the foothold can be reliably fixed to a manhole wall. Still further, since the universal washers are detachable from the foothold, a foothold small in size and low in cost can be achieved.

According to the foothold of the second aspect of the invention, since pins are positioned laterally on the side portions, the foothold can be pressed against the wall surface by allowing the universal washers to be fitted to the inclined surface such as inclined wall of a shore protection.

According to the foothold of the third aspect of the invention, since the upper surface of the tread is inclined upward from the central portion toward the both ends thereof at the angle of 1 to degrees, both legs of a person can be reliably placed on the upper surface of the tread, and hence the person can work safely.

According to the foothold of the fourth aspect of the invention, since reflectors are provided on both cornered portions of the tread wherein the right reflector is red and the other reflector is green, the positions of the right and left portions of the foothold are made clear, thereby providing a reliable foothold capable of orienting the foothold in specific direction.

According to the foothold of the fifth aspect of the invention, since the tread has a wave-shaped grip portion provided at the inner side surface thereof in the axial direction and another wave-shaped grip portion provided at the lower surface of the tread in the axial direction having irregularities thereon, a person can easily grip the tread when going up and down, and both hands are prevented from slipping from the tread, thereby providing a reliable foothold.

According to the foothold of the sixth aspect of the invention, since the foothold comprises belt-shaped projections formed along the outer ends of both side portions, both legs are prevent from laterally slipping from the tread owing to the projections.

According to the foothold of the seventh aspect of the invention, since the foothold comprises rise portions directed upward from both ends of the tread, and the rise portions have side portions provided on upper ends of the rise portions, even if both legs are placed on both ends of the tread when using the foothold, both legs are not laterally slipped from the tread owing to the rise portions.

According to the foothold of the eighth aspect of the invention, since the foothold comprises blow receiving portions at the front side of the tread when the legs are embedded in the concrete wall, the foothold is hardly damaged, when it is fixed to the concrete wall, thereby providing a foothold capable of being reliably fixed to various wall surfaces.

According to the foothold of the ninth and tenth aspects of the invention, since the foothold comprises all the components as set forth in the first to eighth aspects of the invention, small universal washers are swingable in accordance with the shapes of the wall surfaces, and they can be reliably fitted to the wall surfaces. Further, the foothold can be reliably fixed to the walls for example of a manhole by fitting the legs reliably and easily to the holes defined in the wall surfaces. Further, both legs are prevented from laterally slipping from the tread owing to the projections or rise portions even if both legs are placed on the side portions when using the foothold, thereby assuring the safety of the person using the foothold. Further, the foothold is capable of being oriented in a specific direction and the tread can be easily gripped by hands of the person when going up and down the tread, and the foothold is hardly damaged. More still further, the foothold can be reliably fixed to the wall surface, and it can endure for a long period of use while the universal washers are detachable from the foothold, and a foothold small in size and low in cost can be provided. Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A foothold comprising a tread, side portions positioned at both sides of the tread, legs connected to free ends of the side portions for insertion into a concrete wall, said tread, side portions and legs being formed of a core, first and second synthetic resins for covering the core, said second synthetic resin for covering the core of the legs having a substantially circular shape in cross section, and the first and second synthetic resins being integrated with each other, a plurality of fins provided axially on an outer periphery of the second synthetic resin on each of the respective legs in a plurality of stages in the direction from the legs toward the respective side portions, a pin provided on each of the side portions and extending radially therefrom at portions adjacent boundaries between the side portions and legs, a universal washer corresponding to each of the pins which is pressed against the concrete wall by the respective pin, said universal washers each having a substantially elliptical hole through which the respective side portion extends and a recessed groove provided at each end of a short axis of the elliptical hole for accommodating the respective pin.

2. The foothold according to claim 1, wherein said pins are positioned laterally on the respective side portions.

3. The foothold according to claim 1, wherein the upper surface of the tread is inclined upward from the central portion toward the ends thereof at an angle of 1 to 5 degrees.

4. The foothold according to claim 1, wherein reflectors are provided on the tread at portions adjacent both ends thereof, wherein the right reflector is red and the other reflector is green.

5. The foothold according to claim 1, wherein the tread has a wave-shaped grip portion provided at an inner side surface thereof in the axial direction and another wave-shaped grip portion provided at a lower surface of the tread in the axial direction which has irregularities thereon.

6. The foothold according to claim 1, further comprising belt-shaped projections formed along the outer ends of both side portions.

7. The foothold according to claim 1, further comprising a rise portion extending upwardly from each end of the tread, each said rise portion having one of said side portions provided on an upper end thereof so as to project rearwardly therefrom.

8. The foothold according to claim 1, further comprising force receiving portions at a front side of the tread to assist in embedding the legs in the concrete wall.

9. A foothold comprising a tread, side portions positioned at both sides of the tread, legs connected to free ends of the side portions for insertion into a concrete wall, said tread, side portions and legs being formed of a core, first and second synthetic resins for covering the core, said second synthetic resin for covering the core of the legs having a substantially circular shape in cross section, and the first and second synthetic resins being integrated with each other, a plurality of fins provided axially on an outer periphery of the second synthetic resin on each of the respective legs in a plurality of stages in the direction from the legs toward the respective side portions, a pin provided on each of the side portions and extending radially therefrom at portions adjacent boundaries between the side portions and legs, a universal washer corresponding to each of the pins which is pressed against the concrete wall by the respective pin, said universal washers each having a substantially elliptical hole through which the respective side portion extends, and a recessed groove provided at each end of a short axis of the elliptical hole for accommodating the respective pin, wherein the upper surface of the tread is inclined upward from the central portion toward both ends thereof at an angle of 1 to 5 degrees, and reflectors are provided on the tread at portions adjacent both ends thereof, wherein the right reflector is red and the left reflector is green, and the tread has a wave-shaped grip portion provided at an inner side surface thereof in the axial direction and another wave-shaped grip portion provided at a lower surface of the tread in the axial direction having irregularities thereon, and projections are formed along the outer ends of both side portions and force receiving portions are provided at the front side of the tread to assist in embedding the legs in the concrete wall.

10. A foothold comprising a tread, side portions positioned at both sides of the tread, legs connected to free ends of the side portions for insertion into a concrete wall, said tread, side portions and legs being formed of a core, first and second synthetic resins for covering the core, said second synthetic resin for covering the core of the legs having a substantially circular shape in cross section, and the first and second synthetic resins being integrated with each other, a plural of fins provided axially on an outer periphery of the second synthetic resin on each of the respective legs in a plurality of stages in the direction from the legs toward the respective side portions, a pin provided on each of the side portions and extending radially therefrom at portions adjacent boundaries between the side portions and legs, a universal washer corresponding to each of the pins which is pressed against the concrete wall by the respective pin, said universal washers each having a substantially elliptical hole through which the respective side portion extends, and a recessed groove provided at each end of a short axis of the elliptical hole for accommodating the respective pin, wherein a rise portion projects upwardly from each end of the tread, each said rise portion having one of said side portions provided on an upper end thereof, the upper surface of the tread is inclined upward from the central portion toward both ends thereof at an angle of 1 to 5 degrees, and reflectors are provided on the tread at portions adjacent both ends thereof, wherein the right reflector is red and the left reflector is green, while the tread has a wave-shaped grip portion provided at an inner side surface thereof in the axial direction and another wave-shaped grip portion provided at a lower surface of the tread in the axial direction having irregularities thereon, and force receiving portions are provided at the front side of the tread or at the front side of the rise portion to assist in embedding the legs in the concrete wall.

* * * * *

UNITED STATES PATENT AND TRADEMARK OFFICE

CERTIFICATE OF CORRECTION

PATENT NO. : 5,967,256
DATED : October 19, 1999
INVENTOR(S) : Eizo Takahashi

It is certified that error appears in the above-identified patent and that said Letters Patent is hereby corrected as shown below:

Column 10;
Line 64, change "plural" to --- plurality ---.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*